US009380822B2

(12) United States Patent
Foster

(10) Patent No.: US 9,380,822 B2
(45) Date of Patent: Jul. 5, 2016

(54) HAT WITH PROTECTIVE BARRIER

(71) Applicant: Carmen L. Foster, Seattle, WA (US)

(72) Inventor: Carmen L. Foster, Seattle, WA (US)

( * ) Notice: Subject to any disclaimer, the term of this patent is extended or adjusted under 35 U.S.C. 154(b) by 360 days.

(21) Appl. No.: 14/171,628

(22) Filed: Feb. 3, 2014

(65) Prior Publication Data

US 2015/0047112 A1 Feb. 19, 2015

Related U.S. Application Data

(60) Provisional application No. 61/867,487, filed on Aug. 19, 2013.

(51) Int. Cl.
*A42B 1/18* (2006.01)
*A42B 1/06* (2006.01)

(52) U.S. Cl.
CPC . *A42B 1/18* (2013.01); *A42B 1/066* (2013.01); *A41D 2400/26* (2013.01)

(58) Field of Classification Search
CPC ..... A42B 1/18; A42B 1/066; A41D 2400/26
USPC ..... 2/9, 175.6, 184.5, 422
See application file for complete search history.

(56) References Cited

U.S. PATENT DOCUMENTS

| | | | | |
|---|---|---|---|---|
| 336,712 | A | 2/1886 | Garst | |
| 876,452 | A | 1/1908 | Harrison et al. | |
| 1,359,393 | A | 11/1920 | Leak et al. | |
| 1,716,719 | A | 6/1929 | Christopher | |
| 1,780,801 | A | 11/1930 | Shlenker | |
| 1,791,609 | A * | 2/1931 | Woodman | A01K 55/00 2/4 |
| 1,955,232 | A * | 4/1934 | Gallaway | G02C 3/02 2/10 |
| 2,472,033 | A | 5/1949 | Wetzel | |
| 4,214,318 | A | 7/1980 | Gomez | |
| 4,397,044 | A | 8/1983 | Trepanier | |
| 4,964,171 | A | 10/1990 | Landis | |
| 4,965,887 | A | 10/1990 | Paoluccio et al. | |
| 5,226,189 | A | 7/1993 | Blutstein | |
| 5,367,706 | A | 11/1994 | Davidson | |
| 5,544,361 | A | 8/1996 | Fine et al. | |
| 5,577,271 | A | 11/1996 | Davis | |
| 5,713,076 | A | 2/1998 | Davis | |
| 5,732,410 | A * | 3/1998 | Machson | A61F 9/029 128/857 |
| 5,790,986 | A | 8/1998 | Hall | |
| 5,933,871 | A | 8/1999 | Kraft | |
| 5,950,241 | A | 9/1999 | Gomez | |
| 6,233,738 | B1 | 5/2001 | Siracusa | |
| D450,173 | S | 11/2001 | Allen | |
| 6,500,214 | B1 | 12/2002 | Muirhead | |
| 6,588,021 | B2 | 7/2003 | Kronenberger | |
| 7,055,179 | B2 | 6/2006 | Warner et al. | |

(Continued)

*Primary Examiner* — Katherine Moran
(74) *Attorney, Agent, or Firm* — George C. Rondeau, Jr.; Davis Wright Tremaine LLP

(57) ABSTRACT

A protective headwear apparatus having a head receiving portion sized to receive the head of the user when worn by the user and a forward extending brim portion attached to the head receiving portion. Further included is a flexible mesh shield having an upper and lower end portions, and a binding stitched to a bottom side of the brim portion with an outwardly facing opening receiving and holding therein the upper end portion of the shield to attach the shield to the brim portion with the shield extending outward out of the outward facing opening of the binding and then bending downward with the lower end portion located lower than the upper end portion of the shield when the apparatus is worn by the user. The shield is sized to wrap at least partially around the head of the user when the apparatus is worn by the user.

28 Claims, 12 Drawing Sheets

(56) References Cited

U.S. PATENT DOCUMENTS

| | | | | |
|---|---|---|---|---|
| 7,076,810 | B1 | 7/2006 | Rossini | |
| 7,107,625 | B2 | 9/2006 | St-Germain | |
| D684,342 | S | 6/2013 | Arenson et al. | |
| D684,753 | S | 6/2013 | Arenson et al. | |
| D689,524 | S | 9/2013 | Peschel | |
| 2009/0229028 | A1 | 9/2009 | Dobkins | |
| 2012/0210491 | A1 | 8/2012 | Bryan et al. | |
| 2013/0145525 | A1 | 6/2013 | Arenson et al. | |
| 2013/0326791 | A1* | 12/2013 | Woo | A42B 1/18 2/172 |

* cited by examiner

HAT WITH PROTECTIVE BARRIER

CROSS REFERENCE TO RELATED APPLICATION(S)

This application claims the benefit of U.S. Provisional Patent Application Ser. No. 61/867,487, filed on Aug. 19, 2013, the content of which is incorporated herein by reference in its entirety.

BACKGROUND

Agricultural workers often work in fields among plants or trees having stiff branches and sharp edged leaves. There are also crops which transfer residue to the skin, resulting in severe irritation. Much of the time, field laborers are exposed to the sun for extended hours. One or more of these elements can cause injury when the face and neck are exposed. As one example, in a process known as detasseling, workers move among rows of corn to remove pollen-producing tassels from the plants. During detasseling season, the plant leaves have sharp edges and residue that will scratch and irritate exposed areas of the face and neck. There is often a need for a hat to be worn by field workers that includes coverage from the sun, and a barrier to laterally protect the face and neck. It is desirable that such a design maintain an innovative margin of space between the crop and the worker. The assembly should not obstruct visibility or ventilation to a measurable degree. And finally, the assembly should improve the level of comfort during long hours of use. The present disclosure meets this and other needs.

BRIEF DESCRIPTION OF THE DRAWINGS

Various embodiments in accordance with the present disclosure will be described with reference to the drawings, in which.

DETAILED DESCRIPTION

Figure 1:
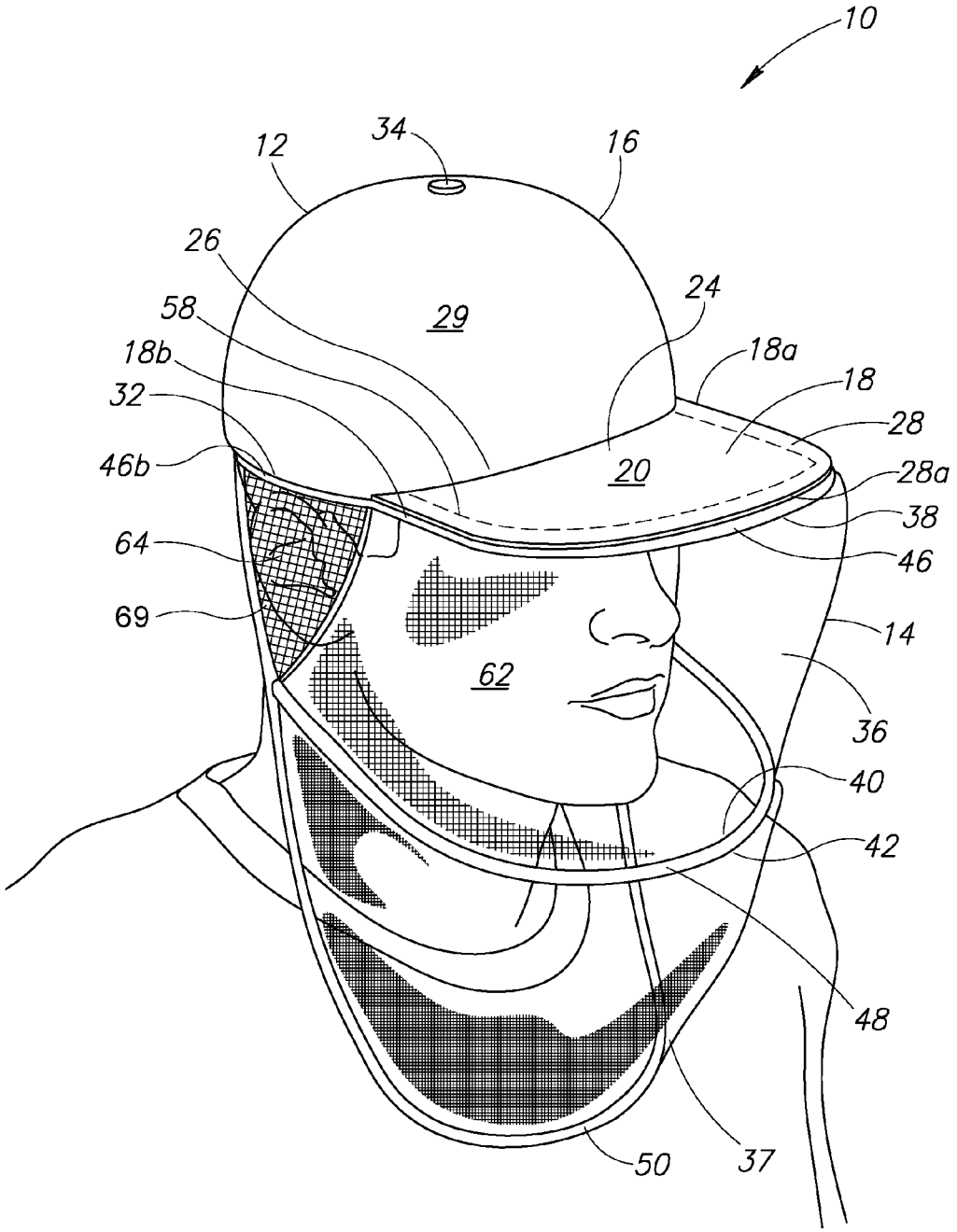
FIG. 1 is a top right side perspective view of a first embodiment of a hat with protective barrier when worn by a user.

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

In FIGS. 1-4, a first embodiment of a headwear apparatus 10 is shown. The headwear apparatus in this embodiment comprises a baseball cap or hat 12 with a protective barrier 14 attached thereto. The hat 12 includes a crown 16 and a brim 18. The brim 18 has a top surface 20, a bottom surface 22, a rear edge portion 24 fixedly attached to a front side 26 of the crown 16, and a front edge portion 28 extending between where the left and right sides 18*a* and 18*b*, respectively, of the brim terminate at the crown. The crown 16 has an outer surface 29, an inner surface 30, and a base portion 32 extending about a lower edge portion of the crown. The crown may be of any suitable shape. In some embodiments, the crown may be constructed of a plurality of tapered segments of solid fabric, mesh fabric, or combinations thereof. Optionally, the crown may have a button 34 on top thereof. In some embodiments, the crown of the hat can have a generally polygonal shape (not shown) and a generally flat top, and can be constructed of square-shaped or rectangular-shaped segments of solid or mesh fabric, or combinations thereof. In some embodiments, the crown may have an opening in an upper portion thereof to form a visor, rather than a baseball cap.

In some embodiments, the crown 16 has an adjustment mechanism which may be used to increase or decrease the circumference of the crown 32, to accommodate various users. For example, the crown circumference may be completed at the center back of the crown 32 by using a band that may be adjusted in length (e.g., via snap closure, hook and loop fasteners, elastic material, etc.).

Figure 3:
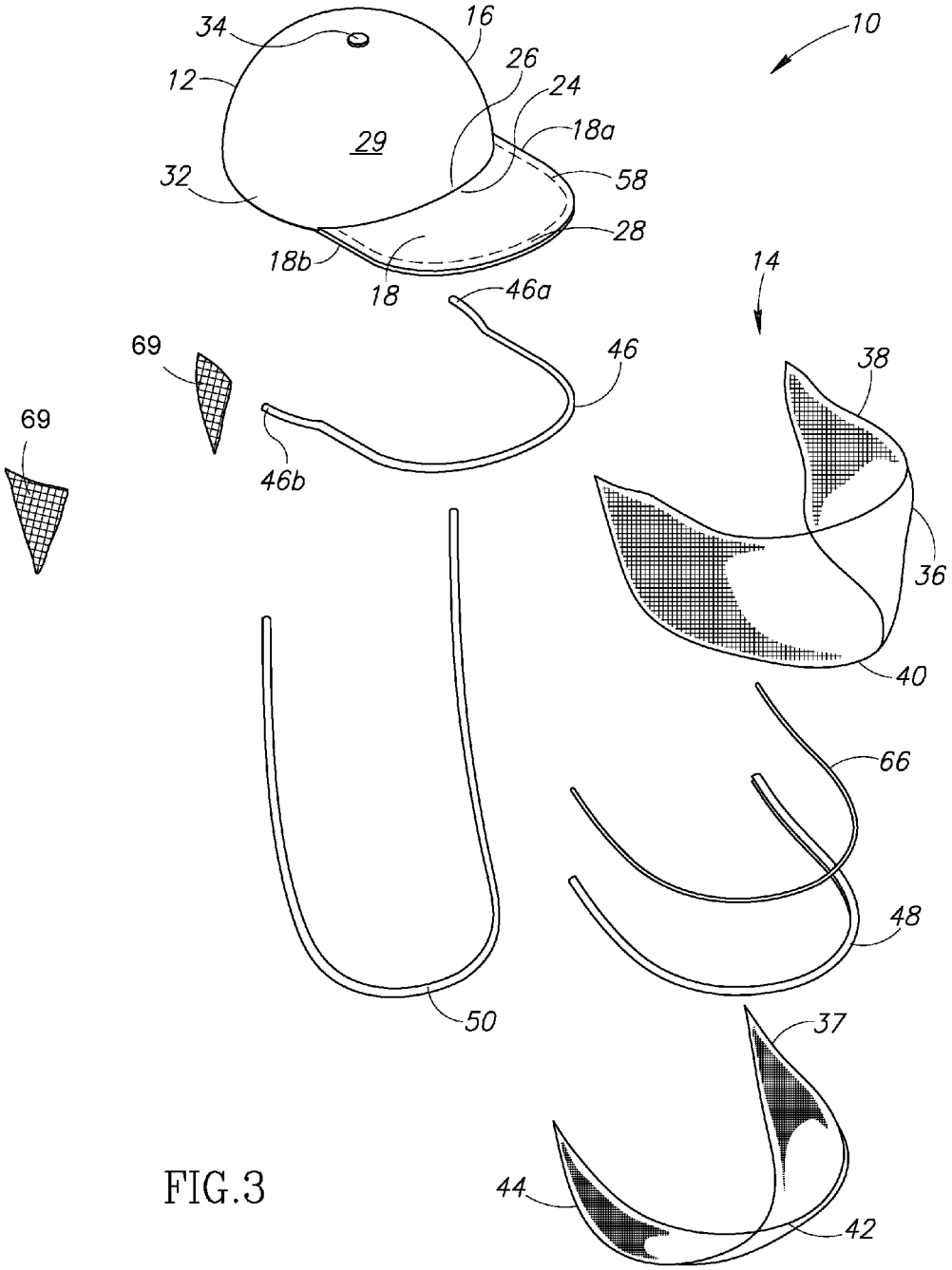
FIG. 3 is a top right side exploded perspective view of the hat with protective barrier shown in FIG. 1.

In this embodiment, the protective barrier 14 includes a flexible upper mesh 36 attached to the brim 18 of the hat 12 and to the base portion 32 of the crown 16, and a flexible lower mesh 37 attached to and extending downward from the upper mesh. As illustrated in FIG. 3, the upper mesh 36 includes a top edge portion 38 and a bottom edge portion 40. Similarly, the lower mesh 37 includes a top edge portion 42 and a bottom edge portion 44. In some embodiments, the top edge portion 38 of the upper mesh 36 is finished with a flexible binding 46. The bottom edge portion 40 of the upper mesh 36 and the bottom edge portion 44 of the lower mesh 37 may also be finished with bindings 48 and 50, respectively. As used herein, the term "binding" generally refers to a separate piece of fabric folded over the edge of another piece of fabric, in this case an edge of the upper mesh 36 or the lower mesh 37.

Figure 2:
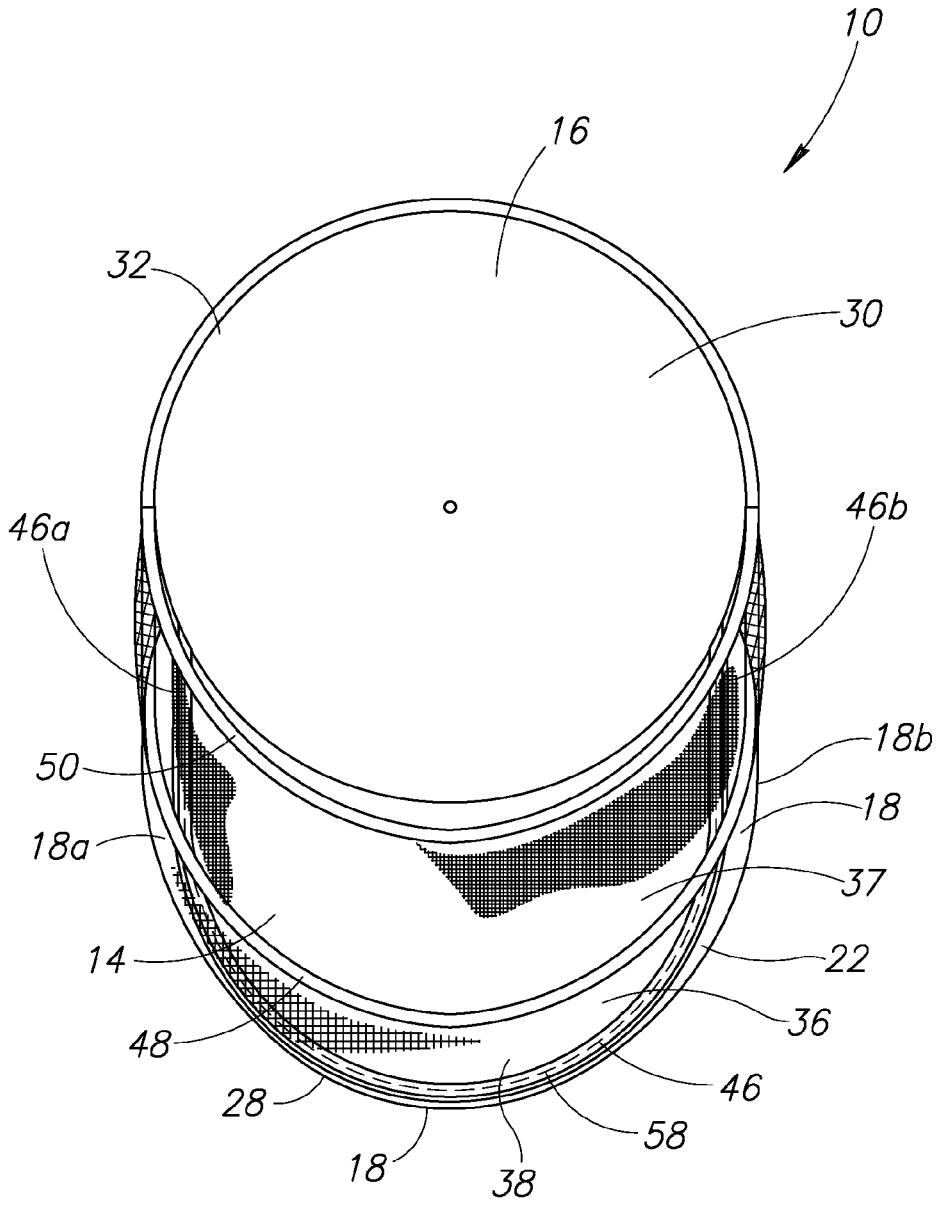
FIG. 2 is a bottom plan view of the hat with protective barrier shown in FIG. 1.
Figure 4:
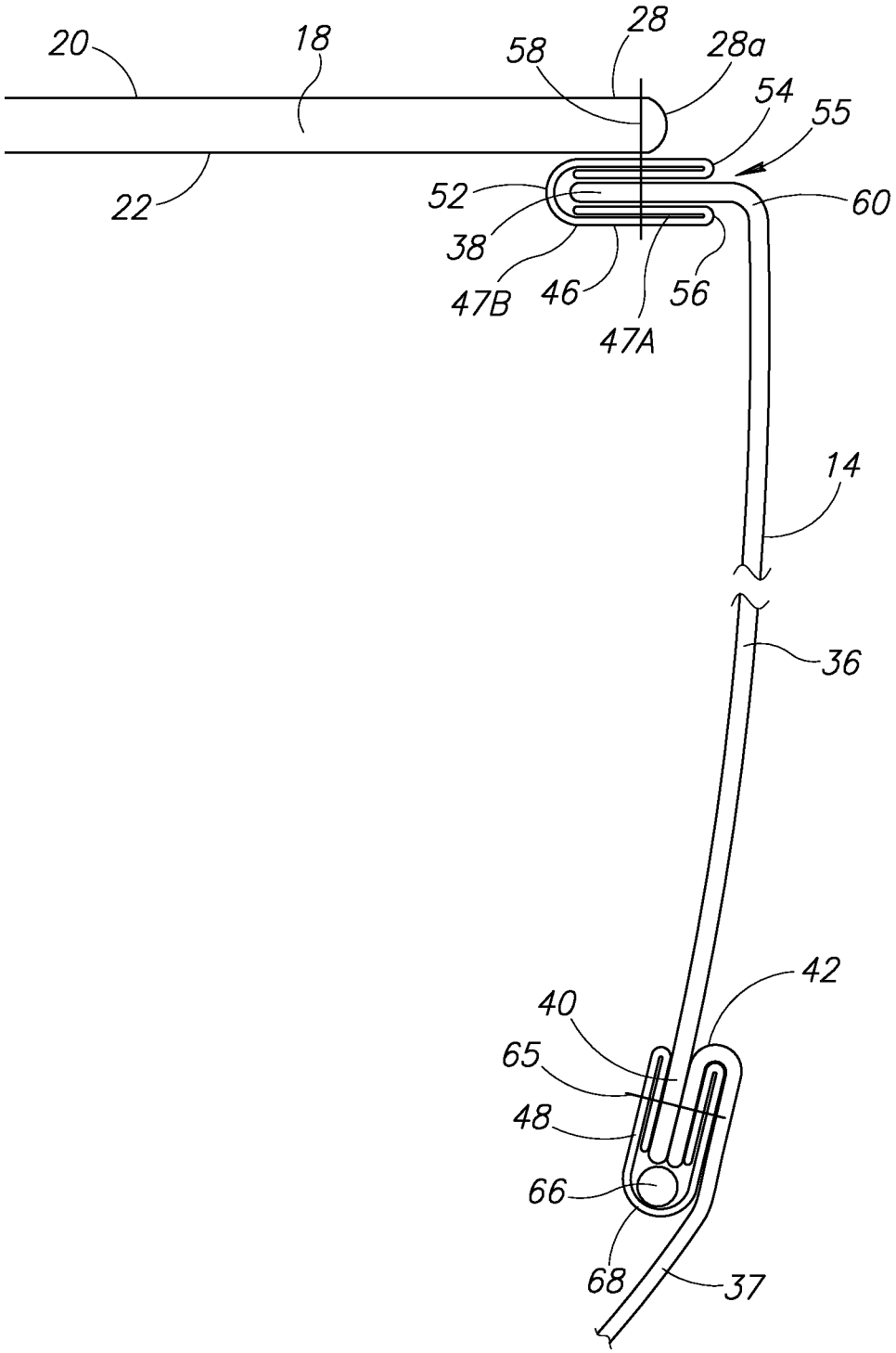
FIG. 4 is a partial sectional view of a brim of the hat shown in FIG. 1 and the protective barrier.

As best shown in FIG. 4, the binding 46 for the top edge portion 38 of the upper mesh 36 comprises a first fold 52, a second fold 54, and a third fold 56 (known as a "tri-fold" binding). In other embodiments the binding may include less than three folds. The second fold 54 and the third fold 56 define therebetween a longitudinally extending opening 55 facing outward and extending about the front edge portion 28 of the brim 18 with the opening positioned outward beyond the outer edge 28*a* of the front edge portion 28. The top edge portion 38 of the upper mesh 36 extends through the opening 55 and is positioned within the first fold 52 of the binding 46 and the binding and top edge portion of the upper mesh are sewn to the bottom surface 22 of the brim 18 along its front edge portion 28 with stitching 58 extending along the binding. As shown in FIG. 2, rearward left and right side end portions 46*a* and 46*b*, respectively, of the binding 46 are sewn to the inner surface 30 of the base portion 32 of the crown 16 at the lower edge portion thereof and located rearward of the corresponding left and right sides 18*a* and 18*b* of the brim.

Still referring to FIG. 4, the portion of the binding 46 between the first fold 52 and the second fold 54 is sewn to lay against the bottom surface 22 of the brim 18, with the first fold 52 of the binding 46 positioned inward from the outer edge 28*a* of the front edge portion 28 of the brim. The second fold 54 and third fold 56 are positioned outward of the outer edge 28*a* of the front edge portion 28 of the brim 18 such that a forward edge portion of the binding 46 extends outward beyond and overhangs the outer edge 28*a* of the front edge portion 28 of the brim 18 and the outward facing opening 55 of the binding 46 is located spaced outward of the outer edge 28*a* of the front edge portion 28 of the brim. Thus, the upper mesh 36, with its top edge portion 38 sewn to the brim 18, extends outward from the opening 55 of the binding 46 and at an outwardly located bend point 60 bends or curves downward and extends downward to the lower mesh 37 and tends to bow outward away from the face of the user. By so extending outward, rather than inward, the upper mesh 36 is spaced further from the user's face 62 during use. Further, this configuration makes the upper mesh 36 less susceptible to collapsing inward toward the face 62 of the user wearing the headwear apparatus 10 when objects such as crop leaves and branches contact the outer surface of the protective barrier 14 during use than is the case if the binding attaching the upper mesh to the brim has its opening facing inward toward the face of the user.

Using a binding with an inward facing opening (i.e., facing the opposite direction as the opening 55 of the binding 46 shown in FIGS. 1-4), the upper mesh extends inward toward the face of the user after exiting the binding and bends downward so when an object contacts and presses against the upper mesh pushing it toward the face of the user, the upper mesh is being moved toward its more relaxed unbent shape and is less resistant to being so moved. This is compared to the binding 46 with the outward facing opening 55 where the upper mesh 36 extends outward away from the face of the user after existing the binding 46 and then bends downward so when an object contacts and presses against the upper mesh pushing it toward the face of the user, the upper mesh is being moved in a direction of increased bending and hence provides increase resistance to being so moved. This makes it less likely the upper mesh 36 will collapse inward toward the face 62 of the user wearing the headwear apparatus 10 when an object contacts the outer surface of the protective barrier 14 during use. That is, a higher force is required to cause such an inward collapse of the upper mesh 36 than if the outward facing opening 55 of the binding 46 was inward facing. The presence of the binding 48 attached to the bottom edge portion 40 of the upper mesh 36 provides additional resistance to inward collapse of the upper mesh.

In addition, by positioning the opening 55 of the binding 46 at the top edge portion 38 of the upper mesh 36 beyond the outer edge 28*a* of front edge portion 28 of the brim 18, when used with a hat having a conventional short brim, such as the case with many baseball style caps, the upper mesh is kept at an increased distance from the front of the face 62 of the user of the headwear apparatus 10 sufficient to maintain better vision, air flow, etc., while providing protection for the front and sides of the face, including the ears 64 of the user, than with binding with an inward facing opening.

As also best shown in FIG. 4, the binding 46 has a lengthwise extending outer portion 47A disconnected from the bottom surface 22 of the brim 18 along its front edge portion 28 outward of the stitching 58 and a lengthwise extending inner portion 47B attached to the bottom surface of the brim by the stitching 58. Preferably, the outer portion 47A of the binding 46 extends outward at least 0.25 inches beyond where the inner portion 47B is attached to the bottom surface of the brim 18 by the stitching 58. It is to be understood that while FIG. 4 shows a single line of stitching, the inner portion 47B of the binding 46 may be stitched to the brim 18 with multiple lines of stitching or otherwise adhered to the brim. The outermost line of stitching is positioned at least 0.25 inches inward from an outermost edge of the outer portion 47A of the binding 46. The outer portion 47A of the binding 46 extends outward beyond where the inner portion 47B is attached to the bottom surface 22 of the brim 18 sufficient that a portion of the outer portion can bend up to at least 90 degrees downward relative to the inner portion in response to an inward force applied to the protective barrier 14. In the illustrated embodiment, the outermost line of stitching is at least 0.375 inches inward from an outermost edge of the outer portion 47A of the binding 46, and the outer portion 47A extends outward beyond the outer edge of the front edge portion 28 of the brim 18 at least 0.25 inches. The described embodiments have the binding 46 is attached to the bottom surface 22 of the brim 18 with at least the outer portion 47A of the binding projecting outward beyond the outer edge of the brim so as to locate at least a portion of the outwardly facing opening 55 of the binding outward of the outer edge of the front edge portion 28 of the brim 18, and hence at least a portion of the binding 46 project outward at least 0.25 inches beyond the outer edge of the front edge portion of the brim.

By attaching the binding 46 to the bottom surface 22 of the brim 18, the upper mesh 36 does not bend around or contact the outer edge of the front edge portion 28 of the brim 18 which eliminates the mesh engaging the hard outer edge of the brim as it does with hats having the binding attached to the top surface 20 of the brim. Such contact with the outer edge of the brim creates a high stress zone for the mesh and tends to cause the mesh to crack along the perimeter of brim, especially in the front portion of the brim. With the use of the lengthwise extending outer portion 47A of the binding 46 disconnected from the bottom surface 22 of the brim 18 along its front edge portion 28 outward of the stitching 58 and the lengthwise extending inner portion 47B attached to the bottom surface of the brim by the stitching, the flexible binding serves much like an elongated hinge when the protective barrier 14 has an inward force applied thereto, such as when an objects such as crop leaves and branches contact the outer surface of the protective barrier 14 during use. The inward force in transmitted by the upper mesh 36 to the outer portion 47A of the binding 46 which tends to bend relative to the inner portion 47B stitched to the brim 18, with the hinge line extending along the outward side of the stitching 58. Since the bending that results from the inward force occurs at least in part in the flexible binding, the amount of resulting bending of the mesh material of the upper mesh 36 is reduced and hence the cracking that can result from repeated bending in response to inward forces on the protective barrier 14 is reduced.

As with the binding 46, the binding 48 is preferably a "tri-fold" binding having a longitudinally extending opening which receives the bottom edge portion 40 of the upper mesh 36 and the top edge portion 42 of the lower mesh 37 therein with the binding sewn together with stitching 65 to attach the lower mesh to the upper mesh. As shown in FIG. 4, in some embodiments the binding 48 may include a resilient, semi-rigid insert 66 positioned within and extending longitudinally through the first fold 68 of the binding. The semi-rigid insert 66 may be made from, for example, wire, cable, or polymer tubing such as nylon tubing, polyethylene tubing, polypropylene tubing, or other suitable material. The semi-rigid insert 66 functions to provide increased rigidity to the protective barrier 14 and resistance to the inward pressure of leaves and branches as the user moves among crops to maintain the space of the upper mesh 36 apart from the user's face 62 during use and also tends to retain the shape of the protective barrier. Although in the embodiment shown in FIGS. 1-4 only the binding 48 at the bottom edge portion 40 of the upper mesh 36 includes the semi-rigid insert 66, it should be appreciated that one or more of the bindings 46, 48 and 50 may also include a resilient, semi-rigid insert. Further, in some embodiments, none of the bindings includes a resilient, semi-rigid insert.

Figure 1A:
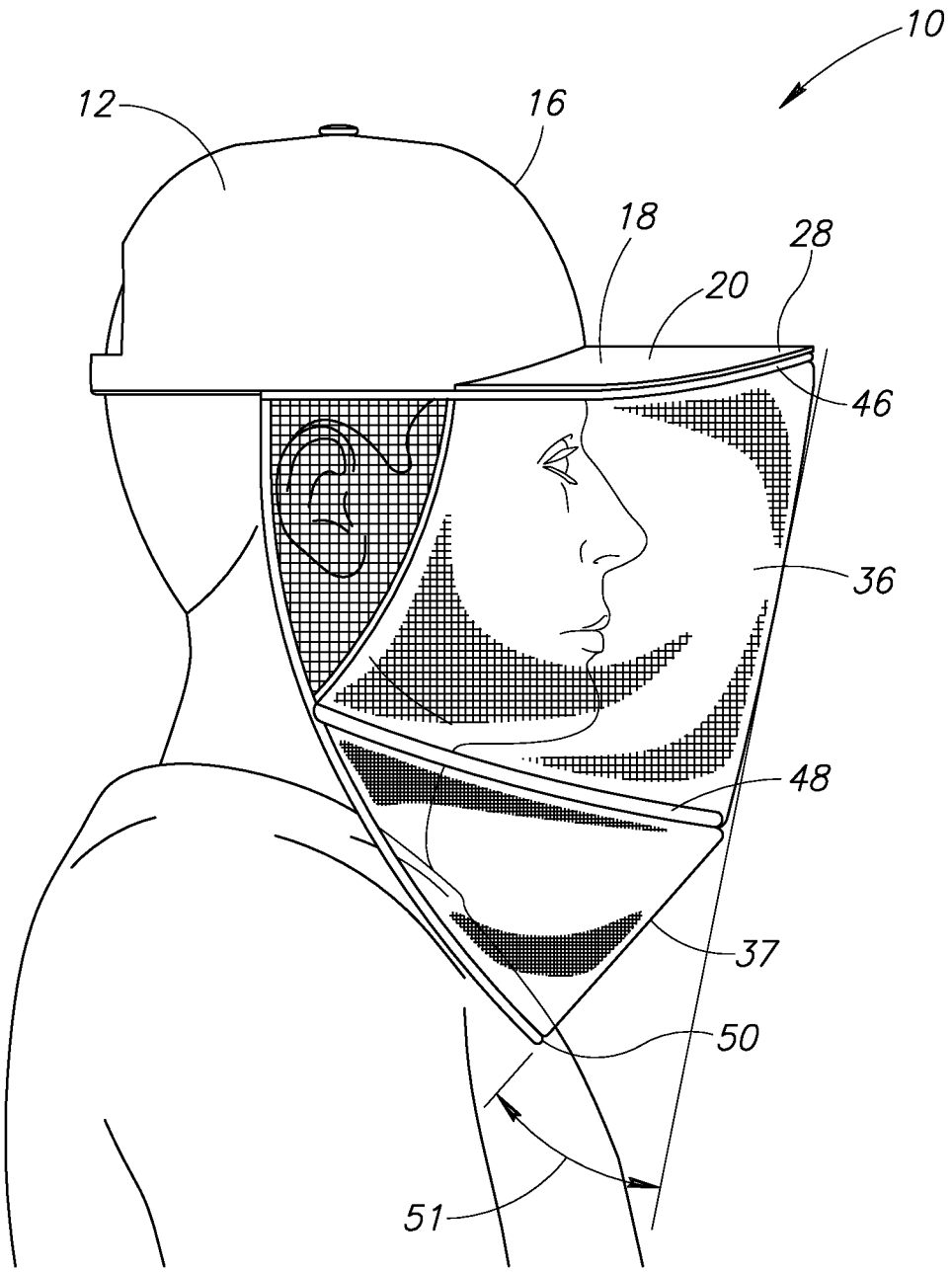
FIG. 1A is a right side elevational view of the hat of FIG. 1.

As best shown in FIGS. 1A and 4, the lower mesh 37 extends inwardly toward the user at an angle 51 greater than zero degrees relative to the upper mesh 36 when the headwear apparatus 10 is worn by the user. In the illustrated embodiment, the lower mesh 37 extends inwardly toward the user with the angle 51 being at least thirty degrees relative to the upper mesh 36 when the headwear apparatus 10 is worn by the user. With this angled arrangement, when the user's head is tilted upward, the bottom edge portion 44 of the lower mesh 37 tends to remain closer to the chest of the user and hence presents less of a gap between the bottom edge portion of the lower mesh through which crop leaves and branches may pass uninhibited by the protective barrier 14 and contact the user. Preferably, the upper mesh 36 and lower mesh 37 extend downward sufficiently that the bottom edge portion 44 of the lower mesh is located at about the chest of the user when the headwear apparatus 10 is worn by the user.

As shown in FIGS. 1 and 4, some embodiments of the headwear apparatus 10 include ear protectors 69 attached to the upper mesh 36 at positions to cover both of the user's ears 64 during use. The ear protectors 69 may be formed of a material adapted to block more sunlight than blocked by the upper mesh 36 alone, such as an alternative woven or knitted mesh, thereby reducing the sun exposure for the user's ears without reducing the ventilation experienced with the upper mesh 36 alone. The ear protectors 69 may be attached over the portion of the upper mesh 36 extending rearward of the left and right sides 18*a* and 18*b* of the brim 18, or may form left and right side rearward portions of the upper mesh 36 which have greater sun-blocking capability than the forward portion of the upper mesh and extend rearward of the left and right sides of the brim over the user's ears 64. Suitable materials include: Semi-stiff mesh with ⅛" sized openings, woven or knitted from polyester or nylon yarns. Wicking mesh knitted from polyester yarns.

In some embodiments, the lower mesh 37 may be formed of a softer and more flexible material than the upper mesh 36 to allow the lower mesh to collapse inward to under the chin of the face 62 of the user as the user wearing the headwear apparatus 10 tilts his or her head downward moving the chin toward the chest. In the chin toward the chest position, use of the softer material for the lower mesh 37 prevents the inward collapse of the lower mesh from also causing the same inward collapse of the upper mesh 36 and producing in wrinkles of the upper mesh which could obstruct the vision of the user. Also, it prevents bending the head downward sufficient to engage the lower mesh 37 with the chest of the user from transmitting an upward force to the stiffer upper mesh 36 and the brim 18 that would otherwise tend to push the hat 12 upward and out of secure fit on the head of the user.

The upper mesh 36 and lower mesh 37 of the protective shield or barrier 14 may be formed from any suitable materials. For example, suitable materials may include a woven vinyl-coated fiberglass or woven vinyl-coated polyester mesh, a knitted polyester or nylon mesh. In some embodiments, the upper mesh or the lower mesh may be treated with clear resins to produce an extra firm finish. Vinyl coatings and Finish Treatments may be used to protect the yarns from degrading over time when exposed to sunlight and weather conditions. Finish treatments may be used to increase the firmness of the mesh, when necessary, to enhance resistance of the protective barrier 14 during crop contact.

The size of each of the openings in the upper mesh and lower mesh may be selected to provide suitable protection while maintaining adequate visibility and ventilation. For example, the size of each of the openings in the upper mesh and lower mesh may range from about 1 millimeter (mm) to 3 mm. Suitable materials may include standard and specialty insect screens commonly used in door and window applications. For example: Phifer company woven vinyl-coated fiberglass products with a firm finish treatment exhibiting 1-3 mm openings: Bettervue®, Ultravue®, standard fiberglass, as well as Phifer company custom screens woven vinyl-coated polyester exhibiting a 3 mm opening. Other suitable materials may include mesh materials knitted from polyester or nylon yarns to exhibit a 1-3 mm opening, the knitted mesh may or may not be treated for a firm finish. In exemplary embodiments, the upper mesh is formed from Phifer 18×16 standard fiberglass with firm finish, and the lower mesh is formed from knitted polyester yarns creating a 2 mm opening. However, by making the openings in the mesh larger, a significant benefit can be achieved. In particular, by using mesh openings sized from 3 mm to 6 mm, or more preferred, 4 mm to 6 mm, the upper mesh 36 will more easily release water build up during dewy mornings or if the sprinklers come on when the user wearing the headwear apparatus 10 when detasseling. Such water build up on the mesh can impair the vision of the user through the upper mesh 36. Of course, the same result will be achieved when the water build up results from working in the rain. By using the larger opening mesh, with a quick shake of the headwear apparatus 10 the water will fall out of the upper mesh 36 and the user can see again. Finer mesh will not so easily let the water go. In one embodiment the mesh has no greater than ten horizontal strands and no greater than ten vertical strands.

It is also advantageous to reduce the diameter of the strands of the mesh. This contributes to making the mesh easy to see through. In one embodiment the mesh has a strand thickness of no greater than 0.018 inches, but may use a strand thickness of from 0.011 inches to 0.018 inches.

Figure 5:
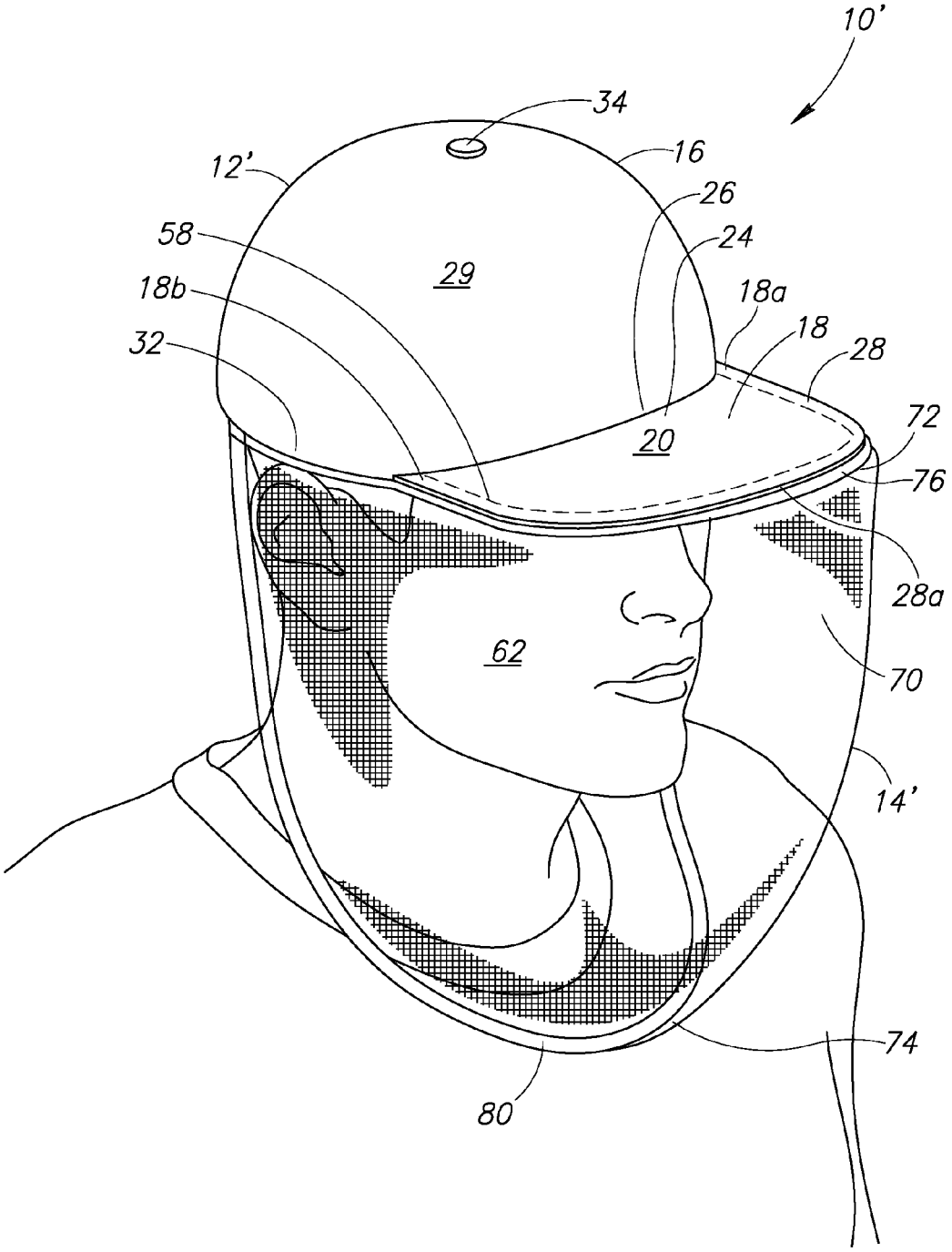
FIG. 5 is a top right side perspective view of a second embodiment of a hat with protective barrier when worn by a user.
Figure 6:
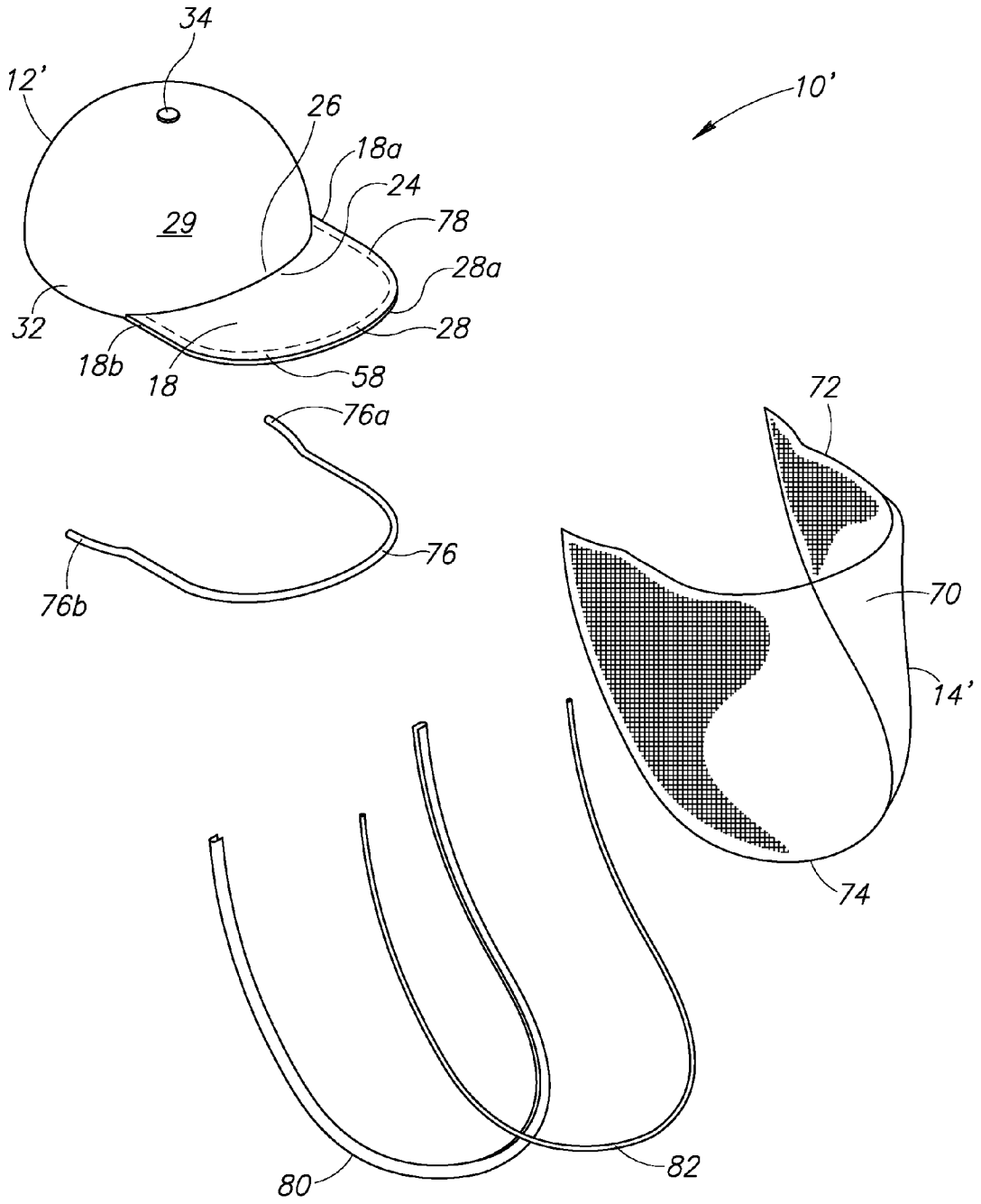
FIG. 6 is a top right side exploded perspective view of the hat with protective barrier shown in FIG. 5.
Figure 7:
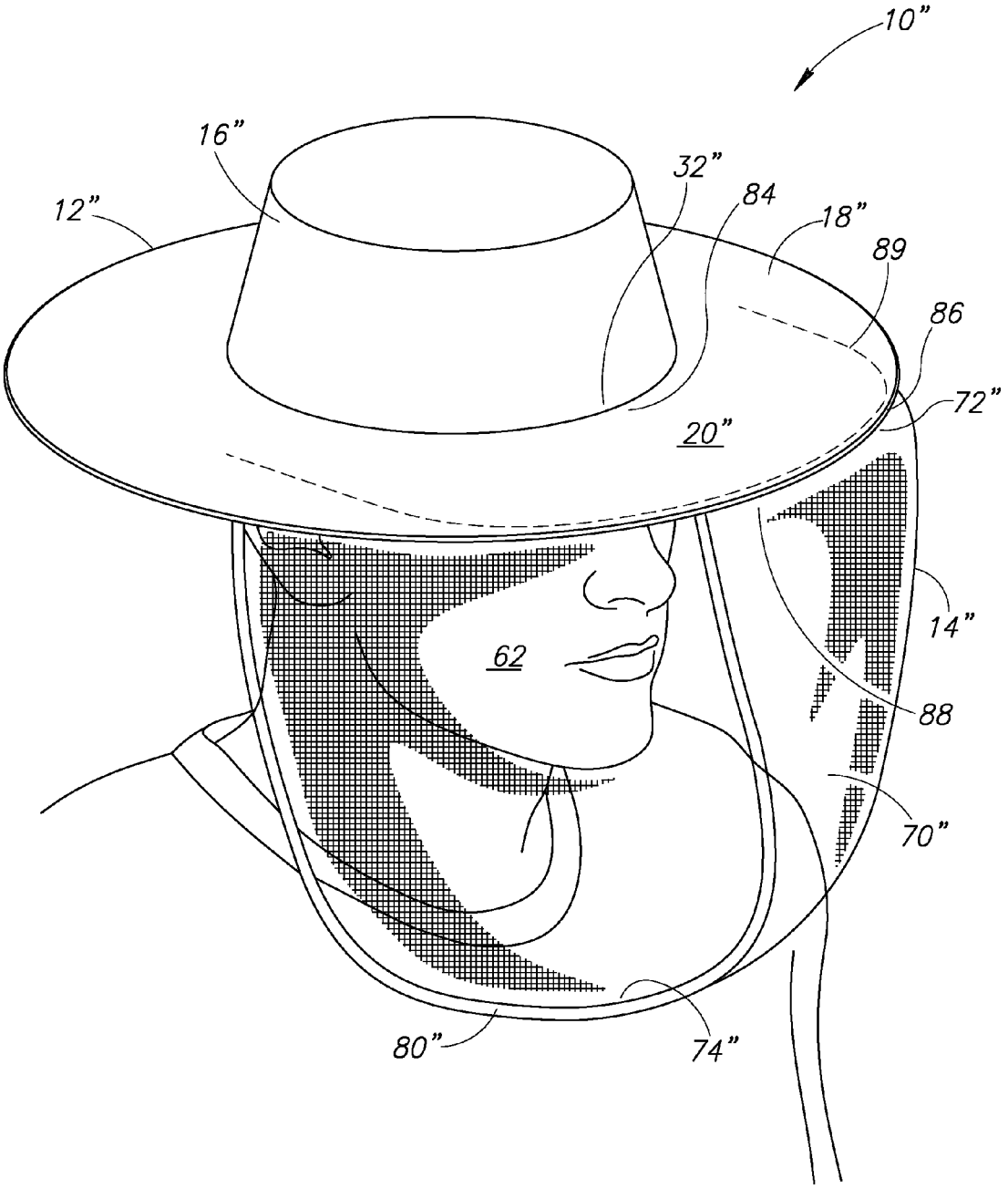
FIG. 7 is a top right side perspective view of a third embodiment of a hat with protective barrier when worn by a wearer.

Referring now to FIGS. 5 and 6, a second embodiment of a headwear apparatus 10' is shown. This embodiment is similar in many respects to the headgear apparatus 10 shown in FIGS. 1-4 and described above. The headgear apparatus 10' comprises a hat 12' that may be substantially the same as the hat 12 of the headgear apparatus 10. In this embodiment, the headgear apparatus 10' comprises a protective barrier 14' formed from a single mesh 70 having a top edge portion 72 and a bottom edge portion 74. A flexible binding 76 is attached to the top edge portion 72 and the binding and top edge portion are sewn on the hat 12' with stitching 58 as described above with reference to the headgear apparatus 10 shown in FIGS. 1-4. Similarly, rearward left and right side end portions 76*a* and 76*b* of the binding 76 are sewn to the inner surface of the base portion 32 of the crown 16 at the lower edge portion thereof and located rearward of the corresponding left and right sides 18*a* and 18*b* of the brim, as shown for the rearward left and right side end portions 46*a* and 46*b* of the binding 46 illustrated in FIGS. 1-4.

A binding 80 is also attached to the bottom edge portion 74 of the mesh 70. The binding 80 on the bottom edge portion 74 comprises a resilient, semi-rigid insert 82 positioned within a fold of the binding 80 as described above for semi-rigid insert 66. The semi-rigid insert 82 functions to provide increased rigidity to the protective barrier 14 and resistance to the inward pressure of leaves and branches as the user moves among crops to maintain the space of the mesh 70 apart from the user's face 62 during use and also tends to retain the shape of the protective barrier. The semi-rigid insert 82 may be made from, for example, wire, cable, or polymer tubing such as nylon tubing, polyethylene tubing, polypropylene tubing, or other suitable material. It should be appreciated that one or both of the bindings may include a semi-rigid insert 82 and, in some embodiments, neither of the bindings includes a resilient, semi-rigid insert.

FIGS. 7-10 illustrate a third embodiment of a headwear apparatus 10". In this embodiment, the headwear apparatus 10" comprises a wide brim hat 12" and a protective barrier 14" attached thereto. The hat 12" comprises a crown 16" and a brim 18" that extends in a radial fashion outward from and about the crown. The brim 18" has a top surface 20", a bottom surface 22", an inner edge portion 84 attached to a base portion 32" of the crown 16", and an outer edge 86. The crown may be of any suitable shape. In some embodiments, the crown of the hat can have a generally polygonal shape and a generally flat top, and can be constructed of square-shaped or rectangular-shaped segments of solid or mesh fabric, or combinations thereof. In some embodiments, the crown may be constructed of a plurality of tapered segments (not shown) of solid fabric, mesh fabric, or combinations thereof. Optionally, the crown may have a button 34 on top thereof. In some embodiments, the crown may have an opening in an upper portion thereof to form a visor, rather than a hat. In some embodiments the brim 18" may not extend fully around the crown 16", especially at the rear of the crown.

In some embodiments, the crown 16" has an adjustment mechanism which may be used to increase or decrease the circumference of the base portion 32" of the crown, to accommodate various users. For example, the crown circumference may be completed with a casing to enclose a draw cord which is adjustable using a spring loaded cord lock. The crown circumference may be completed at center back of the crown 16" by using a band that may be adjusted in length (e.g., via snap closure, hook and loop fasteners, elastic material, etc.).

Figure 9:
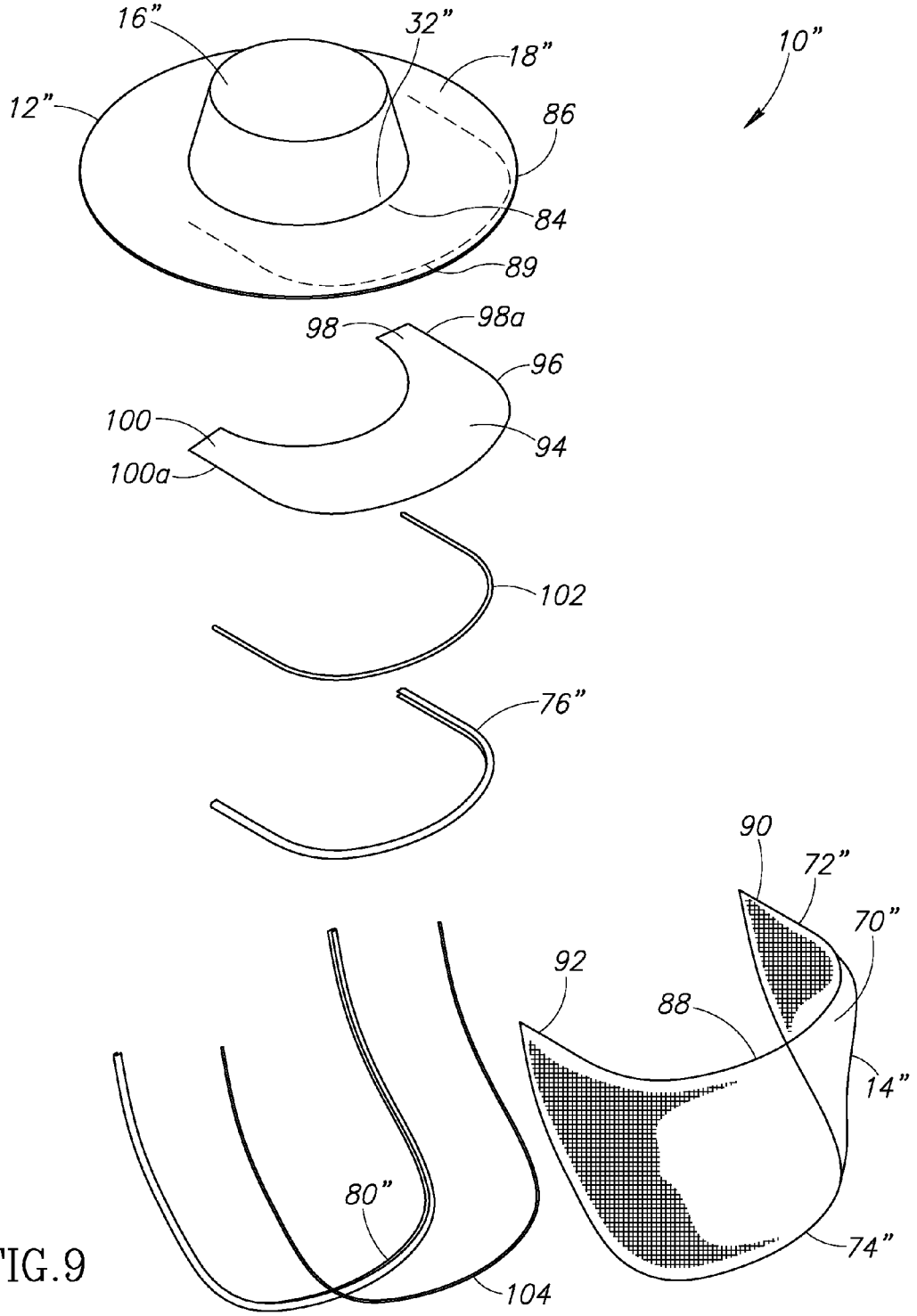
FIG. 9 is a top right side exploded perspective view of the hat with protective barrier shown in FIG. 7.

The protective barrier 14" is attached to the brim 18" such that the protective barrier is positioned to protect the face, ears, and neck of a user during use. Referring to FIG. 9, the protective barrier 14" comprises a mesh 70" having a top edge portion 72" and a bottom edge portion 74". The top edge portion 72" of the mesh 70" is attached to the brim 18" of the hat 12" creating a generally U-shaped configuration. The U-shaped configuration is independent of the circumference of brim 18". The top edge portion 72" is attached to the brim 18" using stitching 89 such that a central portion 88 of the base of the U-shaped top edge portion 72" is positioned at the front-center of the brim about 3.5 inches outward from the base portion 32" of the crown 16". The top edge portion 72" arcuately extends laterally and then rearwardly to both left and right sides of the crown 16" with left and right side portions 90 and 92, respectively, which extend rearward and terminate on the left and right sides, respectively, of the crown 16" at locations at about 0.5 inches outward from base portion 32" of the crown 16" and complete the two legs of the general U-shape. The locations may be as much as 1.5 inches outward from the base portion of the crown in the illustrated embodiment. In this position the mesh 70" wraps around the face 62 of the user and rearward to or beyond the user's ears while being maintained at a distance from the front of the face of the user. In some embodiments, the left and right side portions 90 and 92, respectively, terminate on the left and right sides, respectively, of the crown 16" at locations outward from base portion 32" of the crown 16" by a distance equal to from 0.25 to 0.75 of the distance between the base portion 32" of the crown and the outer edge 86 of the brim 18" measured at the locations laterally outward from where the left and right side portions 90 and 92 terminate on the left and right sides.

It should be understood that while for the illustrated size brim 18" the central portion 88 of the top edge portion 72" is located proximate to the outer edge 86 of the brim, the location at which the top edge portion 72" is stitched to the brim 18" is determined by the distance the mesh 70" is to be located from the face of the user wearing the headwear apparatus 10" to allow for unobstructed visibility and ventilation while accomplishing the necessary protection, and not by the width of the brim 18". As such, for larger size brims the top edge portion 72" of the mesh 70" is located farther inward from the outer edge 86 of the brim 18" than illustrated in FIGS. 7-9.

Figure 8:
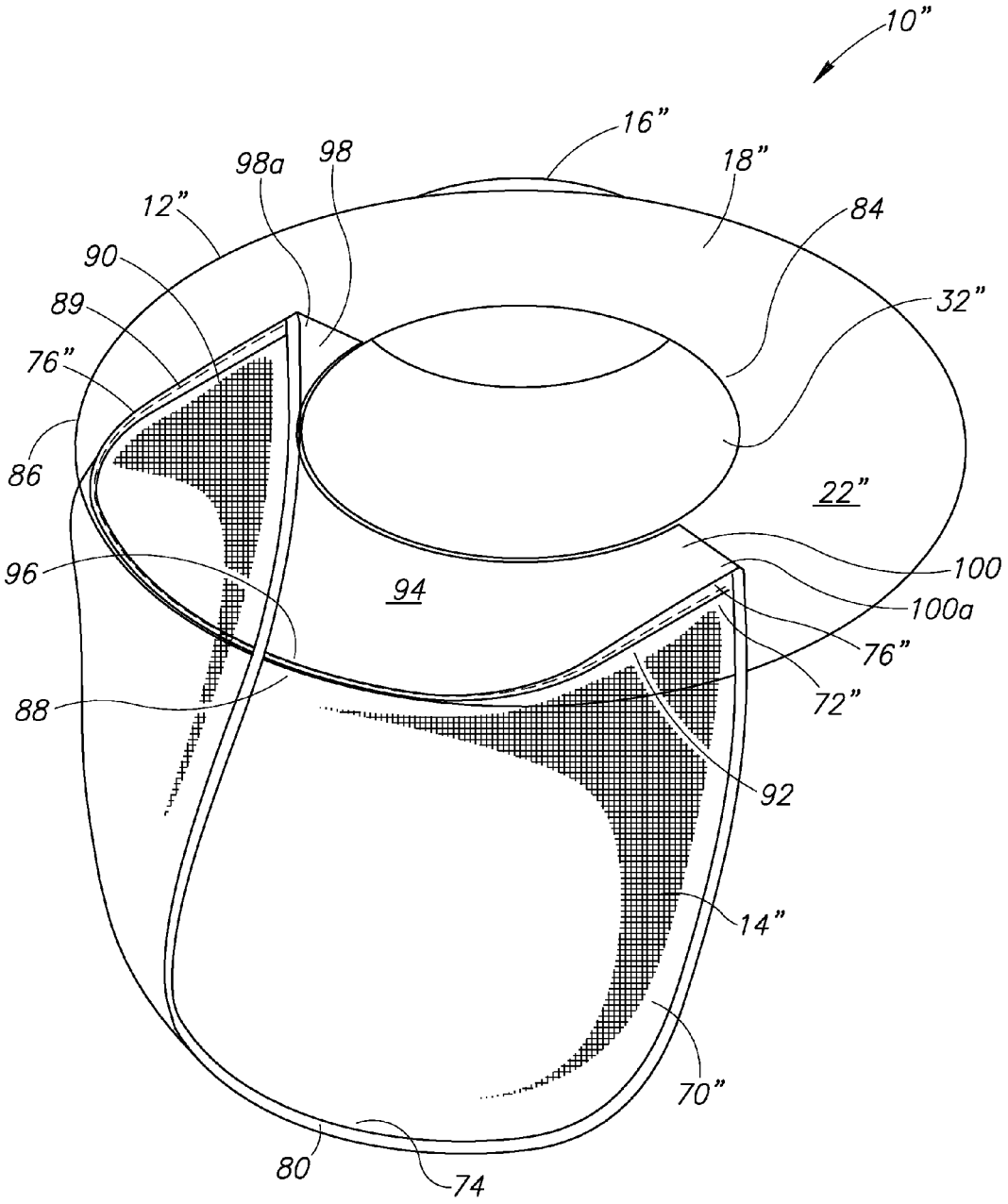
FIG. 8 is a bottom left rear side perspective view of the hat with protective barrier shown in FIG. 7.
Figure 10:
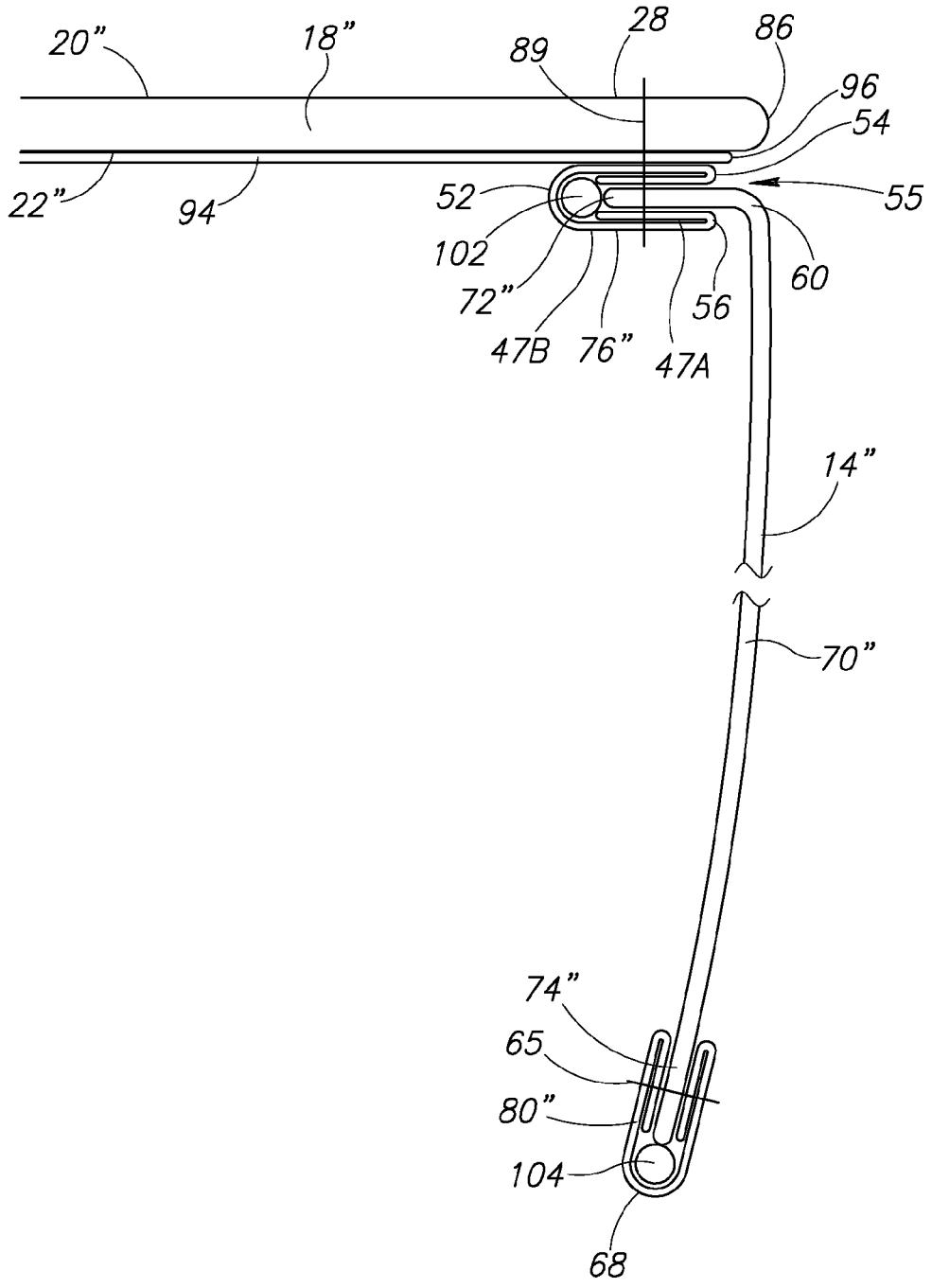
FIG. 10 is a partial sectional view of a brim of the hat shown in FIG. 7 and the protective barrier.

In a preferred embodiment, the brim 18" has a single layer of moisture resistant material which results in a lightweight hat which is cooler under most weather conditions. As shown in FIGS. 8-10, in some embodiments a limited size second layer of material 94 may be attached to the bottom surface 22" of the brim 18". The material 94 may have an outer edge portion 96 that is substantially aligned with a binding 76" by which the top edge portion 72" of the mesh 70" is attached to the brim 18", and an inner edge portion 98 that is substantially aligned with the inner edge portion 84 of the brim 18" whereat the brim is attached to the base portion 32" of the crown 16". The material 94 has left and right leg portions 98 and 100, respectively, with the left leg portion 98 having an outer edge portion **98*a* which corresponds to the location at which the left side portion 90 of the top edge portion 72" of the mesh 70" is stitched to the brim 18" and with the right leg portion 100 having an outer edge portion 100*a* which corresponds to the location at which the right side portion 92 of the top edge portion 72" is stitched to the brim 18"**.

The material 94 is selected to aid in mitigation of the effect of the sun shining through the brim 18" during use but may also provide reinforcing support to the brim 18" which carries the weight of the protective barrier 14". To provide sufficient sun blocking capability to the brim 18" in the area above the eyes of the user, in some embodiments the material is equal to or higher in density when compared to the material forming the brim 18". For example, in some embodiments the material is formed from 1000 denier pack cloth, whereas the brim 18" is fabricated from a single layer of 600 denier urethane coated, polyester pack cloth. By sizing the higher density material 94 to cover the U-shaped configuration by which the top edge portion 72" of the mesh 70" is attached to the brim 18", both support for the mesh 70" and additional sun blocking capability are provided without substantially increasing the weight of the headwear apparatus 10". Further, by aligning the outer edge portion 96 of the material 94 with the binding 76" of the top edge portion 72" of the mesh 70", during construction of the headwear apparatus 10" a sewing technician may utilize the outer edge portion 96 of the material 94 as a guide to properly register the top edge portion to the headwear apparatus. It should be appreciated that the U-shaped configuration of the top edge portion 72" when stitched to the brim 18" may be established with or without the presence of material 94.

As noted, the top edge portion 72" of the mesh 70" is finished with the binding 76". Further, the bottom edge portion 74" of the mesh 70" is finished with a binding 80". Similar to the embodiment shown in FIG. 4, the bindings may include resilient, semi-rigid inserts positioned within a fold of the bindings (see FIG. 4). In the illustrated embodiment of FIGS. 7-10, a single resilient, semi-rigid insert 102 is used in the binding 76" by which the top edge portion 72" of the mesh 70" is attached to the under area 22" of brim 18" and it functions to provide structural support to both the brim and the top edge portion 72" of the mesh 70" of the protective barrier 14". This eliminates the need to use multiple layers of fabric to create a brim firm enough to adequately support the protective barrier, and avoids the expense of stitching together the multiple layers as done in the prior art.

A resilient, semi-rigid insert 104 may also be used in the binding 80" of the bottom edge portion 74" of the mesh 70". The semi-rigid insert 104 functions to provide increased resistance of the protective barrier 14" to inward movement as a result of the pressure of leaves and branches against the protective barrier as the user moves among crops and to maintain the space of the mesh 70' apart from the user's face 62 during use and maintain the shape of the protective barrier 14". When using a single layer of moisture resistant material for the brim 18", even the addition of the material 94 and the semi-rigid inserts 102 and 104, the resulting headwear apparatus 10" still has a lower weight than similar style prior art hats and provides improved comfort for the user since the hat is lighter and cooler.

It should be appreciated that one or both of the bindings 76" and 80" may include a resilient, semi-rigid insert and, in some embodiments, neither of the bindings includes a resilient, semi-rigid insert. It should also be appreciated that while the headwear apparatus 10" is illustrated with a single mesh 70", the headwear apparatus 10" may include a lower mesh, such as the lower mesh 37 used in the embodiment shown in FIGS. 1-4, with a top edge portion and a bottom edge portion, and having the bottom edge portion 74" of the mesh 70" and the bottom edge portion 44 of the lower mesh 37 may also be finished with a binding attaching the mesh 70" to a lower mesh much as illustrated in FIG. 4 for the upper mesh and lower mesh 36 and 37 described above.

Figure 11:
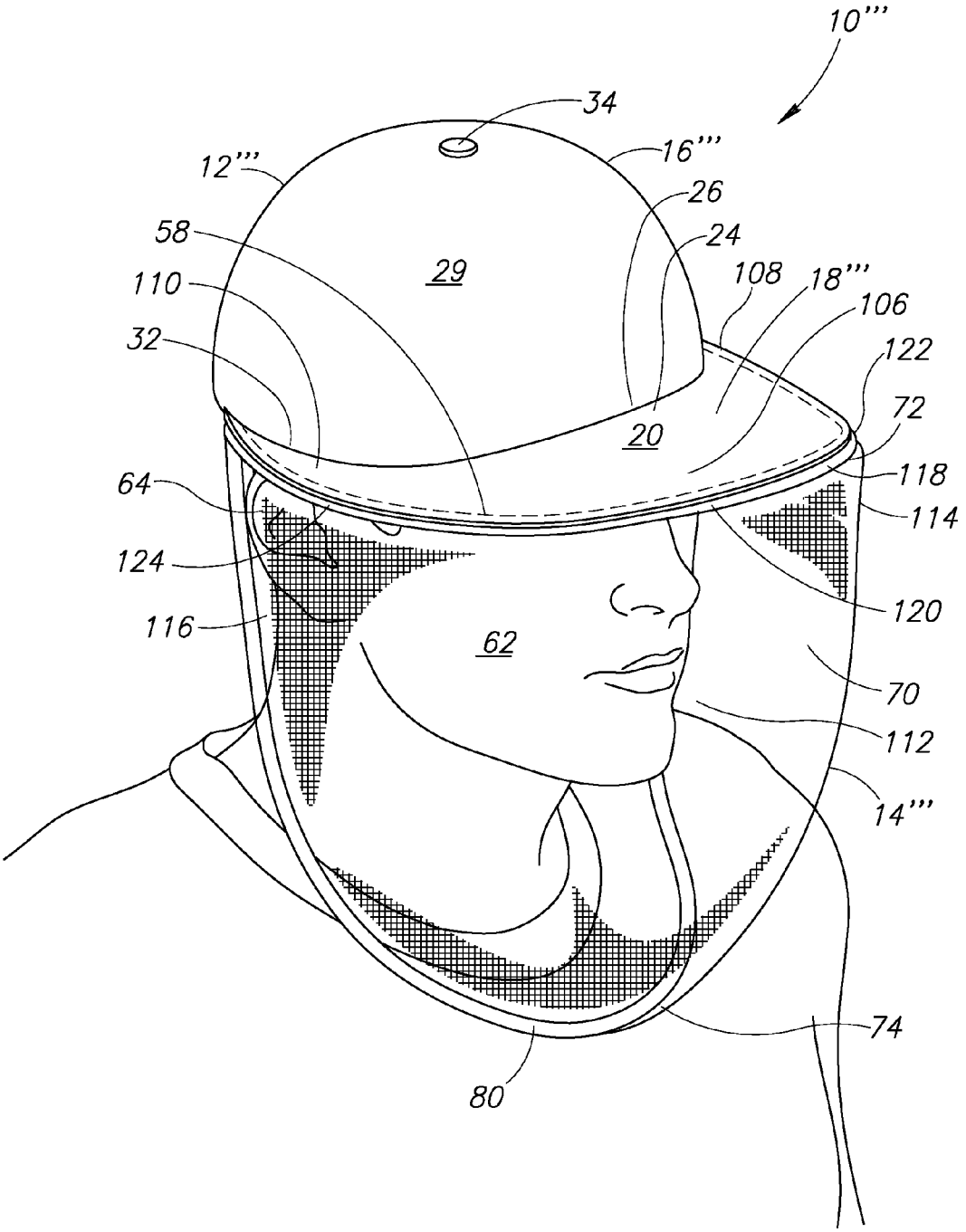
FIG. 11 is a top right side perspective view of a fourth embodiment of a hat with protective barrier when worn by a user.

A fourth embodiment of a headwear apparatus 10'" is shown in FIG. 11. This embodiment is similar in many respects to the headgear apparatus 10' shown in FIG. 5 and comprises a baseball cap style hat 12'" with a crown 16'" and a brim 18'". The brim 18'" has a forward portion 106, a left side portion 108 on the left side of the brim extending rearwardly from the forward brim portion past at least a forward portion of the left ear of the user, and a right side portion 110 on the right side of the brim extending rearwardly from the forward brim portion past at least a forward portion of the right ear of the user when the headwear apparatus 10'" is worn by the user. This embodiment also has a protective barrier 14'" and a flexible binding 118. The protective barrier 14'" has a forward shield or mesh portion 112, a left side shield or mesh portion 114 extending rearwardly from the forward mesh portion and positioned to cover at least a portion of the left ear of the user, and a right side shield or mesh portion 116 extending rearwardly from the forward mesh portion and positioned to cover at least a portion of the right ear of the user when the headwear apparatus 10'" is worn by the user. The flexible binding 118 has a forward portion 120, a left side portion 122 extending rearwardly from the forward binding portion past at least a forward portion of the left ear of the user and having an opening receiving and holding the left side mesh portion 114 therein in position to protect the left ear of the user when the headwear apparatus 10'" is worn by the user, and a right side portion 124 extending rearwardly from the forward binding portion past at least a forward portion of the right ear of the user and having an opening receiving and holding the right side mesh portion 116 therein in position to protect the right ear of the user when the headwear apparatus is worn by the user.

The forward binding portion 120 is attached to the forward brim portion 106, left side binding portion 122 is attached to the left side brim portion 108, and the right side binding portion 124 is attached to the right side brim portion 110 of the brim. The protective barrier 14'" is formed from a single mesh 70 having a top edge portion 72 and a bottom edge portion 74. The binding 118 is attached to the top edge portion 72, and the binding and top edge portion are sewn to the bottom surface of the brim 18'" along the forward brim portion 106, the left side brim portion 108 and the right side brim portion 110 using stitching 58. In the illustrated embodiment, the binding 118 is not sewn to the crown 16'". The binding 118 is attached to the brim 18'" with its opening facing outward as described above for the embodiment of FIGS. 1-4.

In the illustrated embodiment of FIG. 11, the left side mesh portion 114 and the right side mesh portion 116 have a sun blocking property greater than the forward mesh portion 112. The left side mesh portion 114 and a right side mesh portion 116 may each comprise two layers of sun shielding material.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Likewise, any two components so associated can also be viewed as being "operably connected", or "operably coupled", to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

What is claimed is:

1. A protective headwear apparatus for wearing on a head of a user, comprising:

an article of headwear having a head receiving portion sized to receive the head of the user and a brim having a top surface and a bottom surface and extending at least partially around the head receiving portion, the head receiving portion having a forward portion and left and right side portions, and the brim having a forward portion and left and right side portions, the forward portion of the brim having an inward end portion attached to the forward portion of the head receiving portion and an outward end portion spaced outward of the forward portion of the head receiving portion, the left side portion of the brim having an inward end portion attached to the left side portion of the head receiving portion and an outward end portion spaced outward of the left side portion of the head receiving portion, and the right side portion of the brim having an inward end portion attached to the right side portion of the head receiving portion and an outward end portion spaced outward of the right side portion of the head receiving portion;

a flexible shield having an upper end portion and a lower end portion, the upper end portion having a forward upper end portion, and left and right side upper end portions; and a binding having a forward portion and left and right side portions, the forward portion of the binding being attached to the bottom surface of the forward portion of the brim and having an opening receiving and holding therein the forward upper end portion of the shield, the left side portion of the binding being attached to the bottom side of the left side portion of the brim at a position outward of the inward end portion of the left side portion of the brim and inward of the outward end portion of the left side portion of the brim, and having an opening receiving and holding therein the left side upper end portion of the shield, and the right side portion of the binding being attached to the bottom side of the right side portion of the brim at a position outward of the inward end portion of the right side portion of the brim and inward of the outward end portion of the right side portion of the brim and having an opening receiving and holding therein the right side upper end portion of the shield.

2. The protective headwear apparatus of claim 1 wherein the brim is a single layer, moisture resistant brim.

3. The protective headwear apparatus of claim 1 wherein the forward portion and left and right side portions of the binding are arranged in a U-shape.

4. The protective headwear apparatus of claim 1 wherein the left side portion of the binding is attached to the bottom side of the left side portion of the brim at a position at least 0.5 inches outward of the inward end portion of the left side portion of the brim and the right side portion of the binding is attached to the bottom side of the right side portion of the brim at a position at least 0.5 inches outward of the inward end portion of the right side portion of the brim.

5. The protective headwear apparatus of claim 1 wherein the left side portion of the binding is attached to the bottom side of the left side portion of the brim at a position outward from left side portion of the head receiving portion by a distance equal to from 0.25 to 0.75 of the distance between the left side portion of the head receiving portion and the outward end portion of the left side portion of the brim, and the right side portion of the binding is attached to the bottom side of the right side portion of the brim at a position outward from right side portion of the head receiving portion by a distance equal to from 0.25 to 0.75 of the distance between the right side portion of the head receiving portion and the outward end portion of the right side portion of the brim.

6. The protective headwear apparatus of claim 1 wherein the opening of the forward portion of the binding is outwardly facing and the forward upper end portion of the shield extends outward out of the outward facing opening of the forward portion of the binding and then bends downward, the opening of the left side portion of the binding is outwardly facing and the left side upper end portion of the shield extends outward out of the outward facing opening of the left side portion of the binding and then bends downward, and the opening of the right side portion of the binding is outwardly facing and the right side upper end portion of the shield extends outward out of the outward facing opening of the right side portion of the binding and then bends downward.

7. The protective headwear apparatus of claim 1 wherein the binding is elongated and the protective headwear apparatus further includes an elongated resilient member positioned within and extending along at least a lengthwise portion of the binding to provide added rigidity to the brim.

8. The protective headwear apparatus of claim 1 wherein the binding is elongated and the protective headwear apparatus further includes an elongated tubular member positioned within and extending along at least a lengthwise portion of the binding to provide added rigidity to the brim.

9. The protective headwear apparatus of claim 1 further including a layer of sun blocking material attached to the bottom surface of the brim and extending at least partially between the forward portion of the head receiving portion and the forward portion of the binding.

10. The protective headwear apparatus of claim 9 further wherein the layer of sun blocking material attached to the bottom surface of the brim further extends at least partially between the left side portion of the head receiving portion and the left side portion of the binding, and at least partially between the right side portion of the head receiving portion and the right side portion of the binding.

11. The protective headwear apparatus of claim 1 wherein the shield comprises an upper shield portion and a lower shield portion positioned below the upper shield portion, the lower shield portion being comprised of a material having a greater flexibility than the upper shield portion.

12. The protective headwear apparatus of claim 11 wherein the lower shield portion extends inwardly toward the user at an angle greater than zero degrees relative to the upper shield portion.

13. The protective headwear apparatus of claim 12 wherein the lower shield portion extends inwardly toward the user at an angle of at least thirty degrees relative to the upper shield portion.

14. The protective headwear apparatus of claim 11 wherein the upper shield portion has a lower end portion and the lower shield portion has an upper end portion, and the protective headwear apparatus further includes an elongated lower binding with an opening receiving and holding therein the lower end portion of the upper shield portion and the upper end portion of the lower shield portion.

15. The protective headwear apparatus of claim 14 further including an elongated resilient member positioned within and extending along at least a lengthwise portion of the lower binding to provide added rigidity to the shield to assist in retaining the shape of the shield and resisting inward movement of the shield in response to an inward force applied to the shield.

16. The protective headwear apparatus of claim 14 further including an elongated tubular member positioned within and extending along at least a lengthwise portion of the lower binding to provide added rigidity to the shield to assist in retaining the shape of the shield and resisting inward movement of the shield in response to an inward force applied to the shield.

17. A protective headwear apparatus for wearing on a head of a user, comprising:

an article of headwear having a head receiving portion sized to receive the head of the user and a forward extending brim portion attached to the head receiving portion, the brim portion having a top surface and a bottom surface;

a flexible shield having an upper shield portion and a lower shield portion positioned below the upper shield portion, the upper shield portion having an upper end portion and a lower end portion, and the lower shield portion having an upper end portion and a lower end portion, the lower shield portion extending inward toward the user at an angle greater than zero degrees relative to the upper shield portion;

a first binding attached to the brim portion and having an opening receiving and holding therein the upper end portion of the upper shield portion so as to attach the upper shield portion to the brim portion with the shield extending outward out of the opening of the binding and extending downward with the lower end portion located lower than the upper end portion of the shield, the shield sized to wrap at least partially around the head of the user; and an elongated second binding with an opening receiving and holding therein the lower end portion of the upper shield portion and the upper end portion of the lower shield portion.

18. The protective headwear apparatus of claim 17 further including an elongated resilient member positioned within and extending along at least a lengthwise portion of the second binding to provide added rigidity to the shield to assist in retaining the shape of the shield and resisting inward movement of the shield in response to an inward force applied to the shield.

19. The protective headwear apparatus of claim 17 further including an elongated tubular member positioned within and extending along at least a lengthwise portion of the second binding to provide added rigidity to the shield to assist in retaining the shape of the shield and resisting inward movement of the shield in response to an inward force applied to the shield.

20. A protective headwear apparatus for wearing on a head of a user, comprising:

an article of headwear having a head receiving portion sized to receive the head of the user and a forward extending brim portion attached to the head receiving portion, the brim portion having a top surface and a bottom surface;

a flexible shield having an upper shield portion and a lower shield portion positioned below the upper shield portion, the upper shield portion having an upper end portion and a lower end portion, and the lower shield portion having an upper end portion and a lower end portion, the lower shield portion extending inward toward the user at an angle greater than zero degrees relative to the upper shield portion, the lower shield portion being comprised of a material having a greater flexibility than the upper shield portion; and a first binding attached to the brim portion and having an opening receiving and holding therein the upper end portion of the upper shield portion so as to attach the upper shield portion to the brim portion with the shield extending outward out of the opening of the binding and extending downward with the lower end portion located lower than the upper end portion of the shield, the shield sized to wrap at least partially around the head of the user.

21. A protective headwear apparatus for wearing on a head of a user, comprising:

an article of headwear having a head receiving portion sized to receive the head of the user and a forward extending brim portion attached to the head receiving portion, the brim portion having a top surface and a bottom surface;

a flexible shield having an upper shield portion and a lower shield portion positioned below the upper shield portion, the upper shield portion having an upper end portion and a lower end portion, and the lower shield portion having an upper end portion and a lower end portion, the lower shield portion extending inward toward the user at an angle greater than zero degrees relative to the upper shield portion; and a first binding attached to the brim portion and having an opening receiving and holding therein the upper end portion of the upper shield portion so as to attach the upper shield portion to the brim portion with the shield extending outward out of the opening of the first binding and extending downward with the lower end portion located lower than the upper end portion of the shield, the shield sized to wrap at least partially around the head of the user, the opening of the first binding being outwardly facing and the upper end portion of the upper shield portion extending outward out of the outward facing opening of the first binding and then bending downward.

22. A protective headwear apparatus for wearing on a head of a user, comprising:

an article of headwear having a head receiving portion sized to receive the head of the user and a forward extending brim portion attached to the head receiving portion, the brim portion having a top surface and a bottom surface;

a flexible shield having an upper shield portion and a lower shield portion positioned below the upper shield portion, the upper shield portion having an upper end portion and a lower end portion, and the lower shield portion having an upper end portion and a lower end portion;

a first binding attached to the brim portion and having an opening receiving and holding therein the upper end portion of the upper shield portion so as to attach the upper shield portion to the brim portion with the shield extending outward out of the outward facing opening of the binding and extending downward with the lower end portion located lower than the upper end portion of the shield, the shield sized to wrap at least partially around the head of the user;

a second binding with an opening receiving and holding therein the lower end portion of the upper shield portion and the upper end portion of the lower shield portion; and an elongated resilient member positioned within and extending along at least a lengthwise portion of the second binding to provide added rigidity to the shield to assist in retaining the shape of the shield and resisting inward movement of the shield in response to an inward force applied to the shield.

23. The protective headwear apparatus of claim 22 wherein the resilient member is tubular.

24. The protective headwear apparatus of claim 22 wherein the lower shield portion is comprised of a material having a greater flexibility than the upper shield portion.

25. The protective headwear apparatus of claim 22 wherein the opening of the first binding is outwardly facing and the upper end portion of the upper shield portion extends outward out of the outward facing opening of the first binding and then bends downward.

26. A protective headwear apparatus for wearing on a head of a user, comprising:

an article of headwear having a head receiving portion sized to receive the head of the user and a forward extending brim portion attached to the head receiving portion, the brim portion having a top surface and a bottom surface;

a flexible shield having an upper end portion and a lower end portion;

a first binding attached to the brim portion and having an opening receiving and holding therein the upper end portion of the shield so as to attach the shield to the bottom surface of the brim portion with the shield extending outward out of the opening of the binding and extending downward with the lower end portion located lower than the upper end portion of the shield, the shield sized to wrap at least partially around the head of the user;

a second binding with an opening receiving and holding therein the lower end portion of the shield; and an elongated resilient member positioned within and extending along at least a lengthwise portion of the second binding to provide added rigidity to the shield to assist in retaining the shape of the shield and resisting inward movement of the shield in response to an inward force applied to the shield.

27. The protective headwear apparatus of claim 26 wherein the resilient member is tubular.

28. The protective headwear apparatus of claim 26 wherein the opening of the first binding is outwardly facing and the upper end portion of the shield extends outward out of the outward facing opening of the first binding and then bends downward.

* * * * *